United States Patent [19]

Tsukamoto

[11] 4,235,302

[45] Nov. 25, 1980

[54] LOUDSPEAKER

[76] Inventor: Kenkichi Tsukamoto, 47, Koyamashimofusa-cho, Kita-ku, Kyoto-shi, Kyoto-fu, Japan

[21] Appl. No.: 883,986

[22] Filed: Mar. 6, 1978

[30] Foreign Application Priority Data

| | | | |
|---|---|---|---|
| Mar. 15, 1977 | [JP] | Japan | 52/28408 |
| Mar. 15, 1977 | [JP] | Japan | 52/28409 |
| Jul. 13, 1977 | [JP] | Japan | 52-83938 |

[51] Int. Cl.[3] ..... H04R 7/20

[52] U.S. Cl. ..... 181/172; 179/115.5 VC

[58] Field of Search ..... 181/171, 172, 157; 179/115.5 VC, 115.5 ES

[56] References Cited

U.S. PATENT DOCUMENTS

| | | | |
|---|---|---|---|
| 1,759,725 | 5/1930 | Young et al. | 181/171 |
| 1,824,590 | 9/1931 | Bernard | 181/171 |
| 1,848,433 | 3/1932 | Pridham | 181/171 |
| 1,897,294 | 2/1933 | Bernard | 179/115.5 VC |
| 2,014,621 | 9/1935 | Jensen | 181/171 |
| 2,107,920 | 2/1938 | Veal | 181/172 |
| 2,814,353 | 11/1957 | Olson et al. | 181/172 |
| 2,860,721 | 11/1958 | Hassan | 181/172 |
| 3,944,757 | 3/1976 | Tsukamoto . | |

FOREIGN PATENT DOCUMENTS

| | | | |
|---|---|---|---|
| 43928 | 9/1934 | France | 179/115.5 VC |
| 292739 | 6/1928 | United Kingdom | 179/115.5 VC |
| 331828 | 7/1930 | United Kingdom | 179/115.5 R |

*Primary Examiner*—L. T. Hix
*Assistant Examiner*—Benjamin R. Fuller
*Attorney, Agent, or Firm*—Ladas & Parry

[57] ABSTRACT

In a loudspeaker, the diaphragm is connected to the edge member fixedly secured to the frame through an intermediate supporting means, at least one part of the intermediate supporting means is made of a material having a low hysteresis characteristic. According to another aspect of the invention, the construction of a loudspeaker is such that the diaphragm supporting means is separated from the airtight means of the diaphragm, so that the loudspeaker can operate in response to even a small signal with high fidelity.

8 Claims, 14 Drawing Figures

LOUDSPEAKER

BACKGROUND OF THE INVENTION

This invention relates to loudspeakers, and more particularly to the selection of material forming the supporting means of the diaphragm and the construction of the supporting means.

In a loudspeaker such as for instance a direct radiation type loudspeaker as shown in FIG. 1, the peripheral portion of the diaphragm 10 in particular form is, in general, supported by a supporting means 11 called an edge, and the diaphragm 10 is vibrated by a voice coil 12 fixedly secured to the central opening of the diaphragm 10. In this case, the vibration of the diaphragm 10 and accordingly the voice coil 12 is suppressed by a damper 13 and an edge 11. Furthermore, a cap 14 is provided at the center of the diaphragm 10 so as to prevent the passage of the air through the diaphragm.

Since both of the edge 11 and the damper 13 serve to support the diaphragm 10, they will be hereinafter referred to as "a supporting means" when applicable.

Heretofore, in the loudspeaker of this type, the diaphragm is made of paper. Recently, a diaphragm made of carbon fibers has been proposed in the art. However, since the weight is an important factor affecting the characteristics of such a loudspeaker, a method of intentionally coating the diaphragm with a damping agent thereby to increase the internal loss has not been employed. Furthermore, as the damping agent is applied to the edge of the loudspeaker, the response characteristic thereof to a small signal applied thereto is very low.

However, in the loudspeaker, it is desirable that the vibrating part thereof can operate as one unit without deformation and that the supporting means can respond to any small signal.

SUMMARY OF THE INVENTION

In view of the foregoing, it is an object of this invention to provide a loudspeaker in which the diaphragm operates as one unit to respond to any small signal with high fidelity.

The foregoing object and other objects of the invention have been achieved by the provision of a loudspeaker in which, according to the invention, at least one part of the supporting means of the diaphragm is made of a material having a low hysteresis characteristic relative to the hysteresis characteristic of the diaphragm. That is, the loudspeaker is of a double construction in which the damper and/or the edge has a material low in hysteresis characteristic. Furthermore, the loudspeaker according to the invention is of a cubically double construction or a planarly continuous double construction.

The nature, principle and utility of the invention will become more apparent from the following detailed description and the appended claims when read in conjunction with the accompanying drawings.

DETAILED DESCRIPTION OF THE INVENTION

Figure 2:
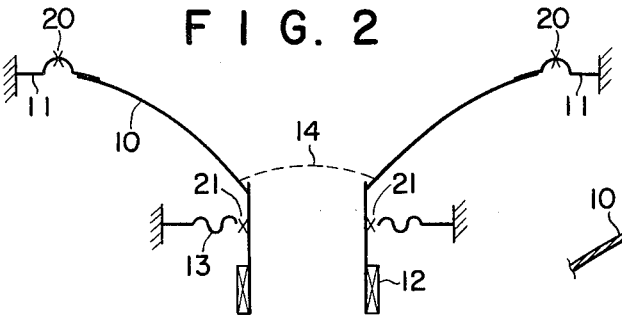
FIG. 2 is a view similar to that of FIG. 1 showing by way of symbolic indications of intermediate supporting means a first embodiment of the invention.

FIG. 2 shows a first embodiment of this invention, which is a direct radiation type loudspeaker in which each of the edge and damper is of a double construction.

Figure 1:
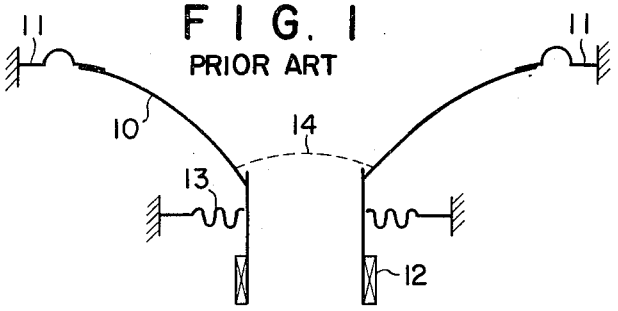
FIG. 1 PRIOR ART
FIG. 1 is a schematic sectional view showing a conventional direct radiation type loudspeaker.
Figure 3:
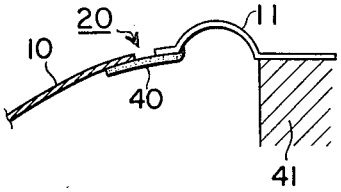
FIGS. 3 through 5 are diagrams showing structural details of intermediate supporting means symbolically indicated in FIG. 2.

In the loudspeaker shown in FIG. 2, intermediate supporting means 20 and 21 are respectively provided for an annular edge member 11 heretofore used by itself (see FIG. 1) and an annular damper member 13. The intermediate supporting means is made of a material whose hysteresis characteristic is low relative to that of the diaphragm 10. According to this invention, a deerskin leather or an artificial leather 40 about 1 mm in length may be interconnected, as the intermediate supporting means 20, between the diaphragm 10 and the edge member 11 fixedly secured to the frame 41, as shown in FIG. 3.

Figure 4:
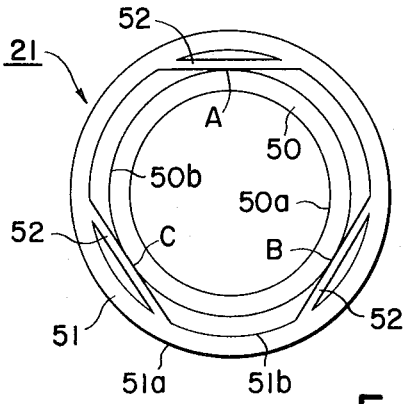
Figure 5:
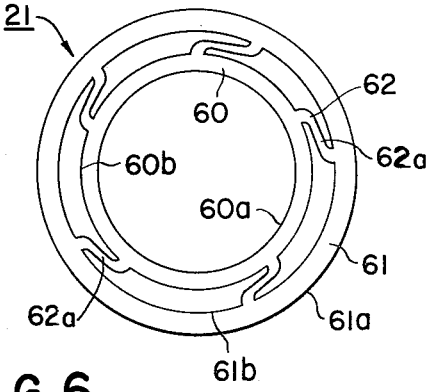

On the other hand, in the case of the intermediate supporting means 21 of the damper member 13, similarly as in the case of the intermediate supporting means of the edge member, deerskin leathers may be interposed between the conventional damper and the conventional coil bobbin. Furthermore, the intermediate supporting means 21 may be obtained by forming one unit with a metallic material such as beryllium copper low in hysteresis characteristic relative to that of the diaphragm as shown in FIGS. 4 and 5. More specifically, the means 21 shown in FIG. 4 has an inner ring 50 and an outer ring 51 which are coaxially arranged with a space of about 1 mm therebetween. The inner ring 50 and the outer ring 51 are connected with straight members 52 which are tangents touching the outer circumference **50*b* of the inner ring 50 at points A, B and C, each tangent being connected to the inner circumference 51*b* of the outer ring 51 at two points. The means 21 shown in FIG. 5 has an inner ring 60 and an outer ring 61 spaced about 1 mm apart from the inner ring 60. Similarly as in the case of the aforementioned means 20, the inner ring 60 and the outer ring 61 are coaxially arranged. The outer and inner rings are connected with connecting members 62 each having a portion 62*a*** oriented in the connection direction. In the intermediate supporting members shown, the outer ring is connected to the inner ring at three or five points. It is desirable that the number of connecting points is a prime number, in view of vibration.

In these intermediate supporting members of the damper member, the inner circumference **50*a* (60*a*) of the inner ring 50 (60) is fastened to the bobbin of the voice coil 12, while the outer circumference 51***a* (61*a*) of the outer ring 51 (61) is fastened to a conventional damper 13 such as a corrugated annular damper.

Figure 6:
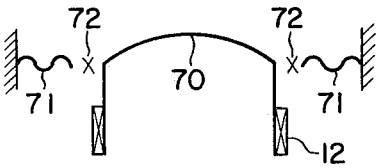
FIG. 6 is an explanatory diagram showing a modification of the first embodiment of the invention.

The invention has been described with respect to the direct radiation type loudspeaker only; however, it should be noted that the invention is not limited thereto or thereby. That is, the diaphragm 70 of a dome radiator loudspeaker or a horn loudspeaker as shown in FIG. 6 may be supported through an intermediate supporting member 72 according to the invention fastened to a conventional damper member 71.

Either one or both of the intermediate supporting means (20 and 21) may be utilized. In fact, in a tweeter for instance, an intermediate supporting means is employed for the edge member only, and electromagnetic damping, mass damping or oil damping is employed; that is, the tweeter can be so designed that no intermediate supporting means is provided for the damper member. Furthermore, with the loudspeaker described above, it is possible to form the edge member with a material such as a deerskin leather low in hysteresis characteristic. In addition, the loudspeaker according to the invention can appropriately employ the resistance control of a cylindrical body disclosed by Japanese Patent Application No. 87720/1973 (corresponding to my U.S. Pat. No. 3,944,757 issued Mar. 16, 1976) for instance.

As is apparent from the above description, the intermediate supporting means according to the invention is more movable than the conventional supporting means, and therefore even if a small signal is applied to the loudspeaker, the diaphragm will vibrate with extremely high fidelity. Furthermore, if the amplitude is increased, the intermediate supporting means will move as one unit with the conventional damper. Thus, the diaphragm is driven with high fidelity in response to any signal applied to the loudspeaker.

Figure 7:
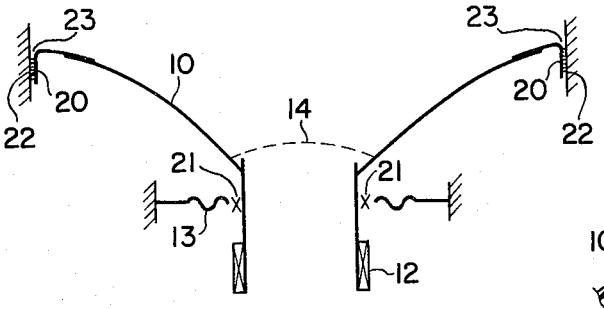
FIG. 7 is an explanatory diagram showing a second embodiment of the invention.

Shown in FIG. 7 is a second embodiment of this invention, which is also a direct radiation type loudspeaker in which each of the damper and edge have an intermediate supporting means, and the edge member is slidable.

In the loudspeaker shown in FIG. 7, the supporting means 20 of the edge member is not directly supported by the frame; that is, it is supported through a film 23 of viscous semi-fluid by a guide means 22. The term "viscous semi-fluid" is intended to mean oil such as BIRAL oil (trademark) which shows rheological behavior, i.e. is resistant to deformation and flow, and which does not flow without an additive and remains in semi-solid state. As the supporting means 20 is freely slidable with respect to the direction of motion of the diaphragm 10, the peripheral portion of the diaphragm 10 is not mechanically fixed, and in addition compliance is positively applied to the peripheral portion of the diaphragm 10 by means of the viscous semi-fluid.

Figure 8:
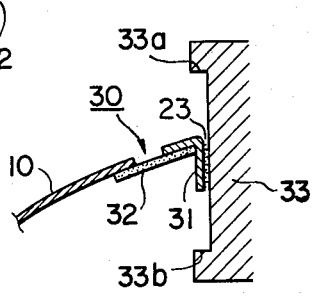
FIG. 8 is a diagram for a description of essential parts of the second embodiment.

Such edge members are shown in FIG. 8. Referring to FIG. 8, the supporting means 30 provided in continuation with the periphery of the diaphragm 10 comprises a sliding member 31 (annular) made of metal or the like, and an intermediate supporting means 32 which is made of a flat ring of deerskin leather low in hysteresis characteristic and is connected to the diaphragm 10 which is spaced about 1 mm apart from the sliding member. The sliding member 31 of the supporting means 30 is engaged with a guide means 33 formed in the frame or the like. The aforementioned viscous semi-fluid 23 fills the gap between the guide means 33 and the sliding member 31 of the supporting means 30. The guide means 33 is provided with limit stops 33*a* and 33*b* so as to prevent the unintentional disengagement of the supporting means 30 from the guide means 33.

In the embodiment described above, it is desirable to provide the damper with intermediate supporting means 21 (FIG. 7) made of a material having a low hysteresis characteristic, similarly as in the case of the edge member. As for the intermediate supporting means 21 of the damper member, similarly as in the case of the edge member, it is possible to provide low hysterisis bridges of deerskin leather pieces between the conventional damper and the coil bobbin. Furthermore, as shown in FIGS. 4 and 5, the means 21 may be formed as one unit with a metallic material such as beryllium copper having a low hysteresis characteristic.

As is apparent from the above description, the loudspeaker according to the invention is formed with intermediate supporting means having a low hysteresis characteristic relative to the hysterisis characteristic of the diaphragm. Therefore, when a small signal is applied to the loudspeaker, the diaphragm vibrates without absorbing the signal by virtue of the action of the intermediate supporting means. When the amplitude of the signal applied to the loudspeaker is greater than a certain value, the diaphragm vibrates along the guide means with the intermediate supporting means and the sliding member as one unit. Furthermore, since the edge member is not directly secured to the frame or the like, deformation of the diaphragm is scarcely caused.

Figure 9:
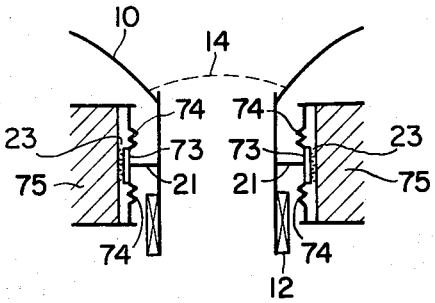
FIG. 9 is an explanatory diagram showing a third embodiment of the invention.

A third embodiment of this invention is shown in FIG. 9, in which the constructions shown in FIG. 8 is utilized for its damper member. In this embodiment, the bobbin of a voice coil 12 has intermediate supporting means 21 as shown in FIGS. 4 or 5, and a cylindrical sliding member 73 made of a metallic material or the like is connected to the outer circumference 51*a* (or 61*a*) of the outer ring 51 (or 61) of the intermediate supporting means 21. The sliding member 73 is engaged with a guide means 75 provided in a magnetic circuit or the like. The both sides of the sliding member 73 are supported by weak springs 74 to obtain the neutral position of the sliding member. The aforementioned viscous semi-fluid 23 fills the gap between the sliding member 73 and the guide means 75.

Figure 10:
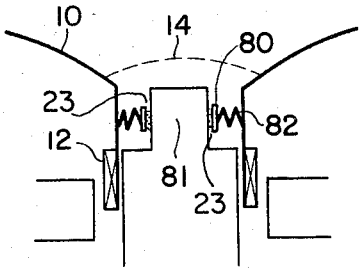
FIGS. 10 and 11 are explanatory diagrams showing modifications of the third embodiment of the invention.

On the other hand, in a center support type loudspeaker also, as shown in FIG. 10, a cylindrical sliding member 80 adapted to slide along a center pole 81 may be supported by a coil bobbin through metallic springs 82 or the means 21 shown in FIGS. 4 or 5.

Figure 11:
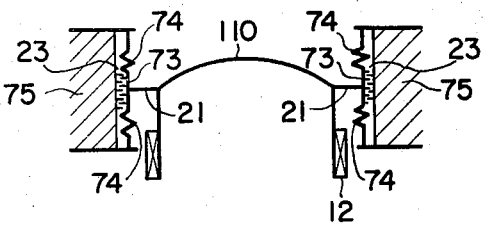

The construction of the type described above may be applied to the case where the diaphragm 110 of a dome radiator loudspeaker or a horn loudspeaker as shown in FIG. 11 is supported. In this case, the bobbin of a voice coil 12 has a supporting means 21 such as those shown in FIGS. 4 and 5, and a cylindrical sliding member 73 made of a metallic material or the like is coupled to the outer circumference 51*a* (or 61*a*) of the outer ring 51 (or 61) of the supporting means 21. The sliding member 73 is engaged with a guide means 75 provided in a magnetic circuit or the like. The both sides of the sliding member 73 are supported by weak springs 74 in the direction of motion of the diaphragm 10 so as to provide the suitable neutral position of the sliding member. In addition, the aforementioned viscous semi-fluid 23 is provided between the sliding member 73 and the guide means 75.

The above-described supporting method can be applied to one or both of the edge member and the damper member.

As is apparent from the above description, since the intermediate supporting means according to this invention is more movable than the conventional supporting means, the diaphragm is vibrated with high fidelity even if a small signal is applied to the loudspeaker; that is, the diaphragm will operate in response to all signals applied to the loudspeaker. If the amplitude of the signal is increased, the intermediate supporting means operates forming one unit with the sliding member, and therefore the diaphragm is scarcely deformed. Thus, according to this invention, the diaphragm will be driven with high fidelity in response to any signal applied to the loudspeaker.

Figure 12:
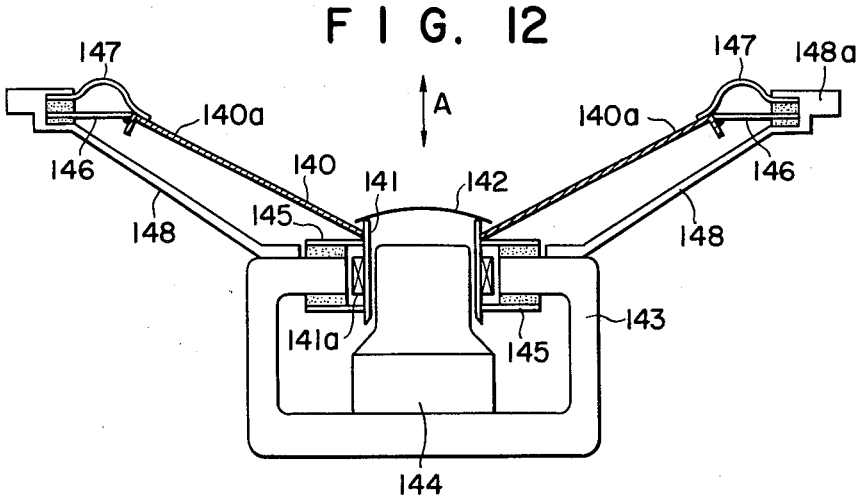
FIG. 12 is a sectional view showing a fourth embodiment of the invention.

Shown in FIG. 12 is a fourth embodiment of this invention, which is a direct radiation type loudspeaker, in which the edge member is of a double construction.

A coil bobbin 141 is fixedly provided at the center of a diaphragm, and a coil 141*a* is wound on the coil bobbin 141. One end of the coil bobbin is covered with a cap 142 to prevent the passage of the air, while the center pole 144 of a magnetic circuit is inserted into the coil bobbin 141 through the other end thereof. Both sides of the coil 141*a* of the coil bobbin 141 are supported through supporting means 145 according to this invention on the yoke 143 of the magnetic circuit.

The peripheral portion 140*a* of the diaphragm 140 is fixedly fastened through the supporting means 146 according to the invention and through an airtight means 147 to the peripheral edge 148*a* of a frame 148 which is extended in conical form from the yoke 143. Accordingly, the coil bobbin 141 and the diaphragm 140 will vibrate in the direction A with the aid of the means 145, 146 and 147.

Figure 13:
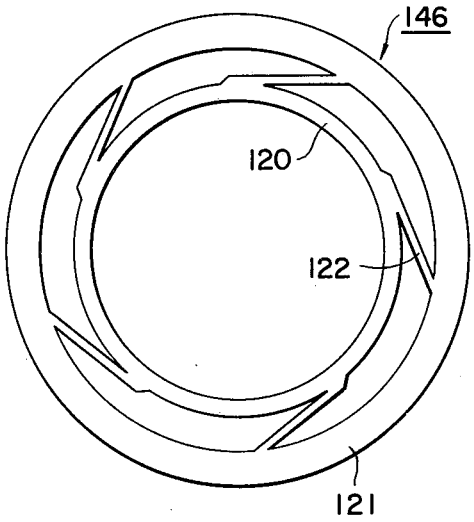
FIG. 13 is a pan view showing a supporting means employed in the embodiment shown in FIG. 12.

The above-described means 145, 146 are similar to those described with reference to FIGS. 4 and 5, and are like that shown in FIG. 13. Shown in FIG. 13 is the supporting means 146 provided sfor the peripheral portion 140*a* of the diaphragm 140. The supporting means 146 has an inner ring 120 and an outer ring 121 which are arranged coaxially with a space of several millimeters therebetween. The inner ring 120 is connected to the outer ring 121 through arms 122 which extend in tangential directions from points on the inner ring 120. Similarly as in the above-described case, it is preferable that the number of connection points between the inner ring 120 and the outer ring 121 is a prime number in view of vibration.

Such a supporting means 146 is obtained by subjecting a supportable material which is not viscoelastic but elastic to photo-etching or pressing. Such a material is beryllium copper or carbon fiber.

The airtight means 147 is to prevent the passage of the air due to the supporting means 146, and is made of a material which is low in viscoelasticity and extremely low in elasticity. Such a material is a deerskin leather or a polyester film for instance. Because of these properties of the airtight means 147, airtightness is positively maintained without disturbing the motion of the supporting means; that is, the vibration of the diaphragm 140 will not be absorbed unintentionally. In other words, the diaphragm can respond to any small signal applied to the loudspeaker.

The construction of the supporting means 145 may be similar to that of the supporting means 146. The supporting means 145 can be obtained by connecting an inner ring whose diameter is equal to the outside diameter of the voice coil 141 to an outer ring whose diameter is equal to the diameter of the yoke 143 with a prime number of arms. The material of the supporting means 145 may be so selected that the supporting means 145 itself performs damping; however, the damping may be effected in any of a number of known ways.

Figure 14:
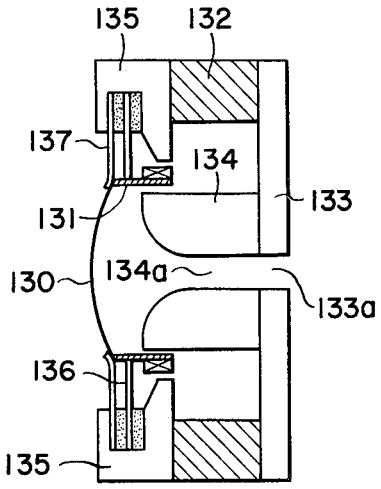
FIG. 14 is a sectional view showing a modification of the embodiment shown in FIG. 12.

The construction of the loudspeaker in which the supporting means of the diaphragm is separated from the airtight means, can be applied not only to a direct radiation type loudspeaker but also to the diaphragm 130 of a dome radiator loudspeaker and a horn speaker as shown in FIG. 14. In the loudspeaker shown in FIG. 14, the diaphragm 130 is fixedly secured to a coil bobbin 131, and the coil bobbin 131 is supported on the yoke 135 of a magnetic circuit through a supporting means 136 and an airtight means 137 which is similar to means 147 of FIG. 12. The magnetic circuit is made up of a magnet 132, a disk 133 adapted as a bottom plate and having a central hole 133*a*, a center pole 134 having a through-hole 134*a*, and the yoke 135.

In the loudspeaker described above, the supporting means and the airtight means are arranged in the stated order as viewed from the rear of the loudspeaker; however, it is obvious that the order of arrangement may be reversed.

As is apparent from the above description, according to the invention, the supporting means of the loudspeaker diaphragm is separated from the airtight means. As a result, it is possible to provide an excellent loudspeaker which can sufficiently respond to even a small signal without absorbing it and which can be suitably damped.

In addition, in order to increase the internal loss, intentionally a damping agent of a viscoelastic material such as semi-plastic epoxy resin, viscolloid, acrylic resin, urethane resin, nitrile or rubber may be applied to the diaphragm.

What is claimed is:

1. In a loudspeaker comprising a frame, a diaphragm assembly having a voice coil fixedly secured to a diaphragm of material possessing a given elastic hysteresis characteristic, and supporting means for supporting said diaphragm assembly from said frame, the improvement wherein at least part of said supporting means is of a material possessing an elastic hysteresis characteristic substantially lower than said given elastic hysteresis characteristic so as to minimize absorption of diaphragm vibrations by said supporting means and thereby increase the response of said diaphragm to any low amplitude signals applied to said voice coil, said supporting means being provided where said voice coil is fixedly secured to the diaphragm of said diaphragm assembly and further including an annular damper member between said frame and said material of substantially lower elastic hysteresis characteristic.

2. The improvement according to claim 1, wherein said at least part of said supporting means comprises a flat ring of leather.

3. The improvement according to claim 1, wherein said at least part of said supporting means is a metal unit comprising an inner planar ring and an outer planar ring coaxially interconnected in spaced coplanar relationship at a prime number of connecting points.

4. The improvement according to claim 1, wherein a second supporting means, at least part of which is of a material possessing an elastic hysteresis characteristic substantially lower than said given elastic hysteresis characteristic is provided at the outer periphery of the diaphragm of said diaphragm assembly.

5. The improvement according to claim 4, wherein said second supporting means further includes an annular edge member between said frame and said material of substantially lower elastic hysteresis characteristic.

6. The improvement according to claim 5, wherein said annular edge member is fixed at its outer periphery to said frame.

7. The improvement according to claim 5, wherein said annular edge member is movably coupled to said frame by a thin film of viscous semi-fluid filling a gap between the outer periphery of said edge member and an adjacent guide portion of said frame.

8. The improvement according to claim 1, wherein said annular damper member is fixed at its outer periphery to said frame.

* * * * *